US012584410B2

(12) United States Patent
Kou et al.

(10) Patent No.: US 12,584,410 B2
(45) Date of Patent: Mar. 24, 2026

(54) DETECTION DEVICE AND METHOD FOR WORKING SURFACE, TERMINAL, AND STORAGE MEDIUM

(71) Applicant: TAIYUAN UNIVERSITY OF TECHNOLOGY, Shanxi (CN)

(72) Inventors: Ziming Kou, Taiyuan (CN); Juan Wu, Taiyuan (CN); Qichao Ren, Taiyuan (CN); Tengyan Hou, Taiyuan (CN); Peng Xu, Taiyuan (CN); Yuchen Li, Taiyuan (CN); Kaiyu Guo, Taiyuan (CN); Mingsong Yuan, Taiyuan (CN); Baoqin Wang, Taiyuan (CN); Lele Luan, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 244 days.

(21) Appl. No.: 18/257,583

(22) PCT Filed: Aug. 17, 2021

(86) PCT No.: PCT/CN2021/113066
§ 371 (c)(1),
(2) Date: Jun. 14, 2023

(87) PCT Pub. No.: WO2022/227344
PCT Pub. Date: Nov. 3, 2022

(65) Prior Publication Data

US 2024/0117740 A1 Apr. 11, 2024

(30) Foreign Application Priority Data

Apr. 28, 2021 (CN) ..... 202110469008.2

(51) Int. Cl.
*E21D 23/14* (2006.01)

(52) U.S. Cl.
CPC ..... *E21D 23/144* (2016.01); *E21D 23/148* (2016.01)

(58) Field of Classification Search
CPC ..... E21D 23/14; E21D 23/144; E21D 23/148
See application file for complete search history.

(56) References Cited

U.S. PATENT DOCUMENTS 4,272,129 A 6/1981 Pearey
5,029,943 A * 7/1991 Merriman ..... E21D 23/146 299/1.7

(Continued)

FOREIGN PATENT DOCUMENTS

CN 87100376 A 9/1987
CN 102661162 A 9/2012

(Continued)

OTHER PUBLICATIONS

International Search Report in the international application No. PCT/CN2021/113066, mailed on Jan. 24, 2022. 6 pages with English translation.

(Continued)

*Primary Examiner* — Janine M Kreck
(74) *Attorney, Agent, or Firm* — Syncoda LLC; Feng Ma

(57) ABSTRACT

Disclosed is a detection device for a working surface. The detection device (100) comprises: a plurality of hydraulic supports (101), a laser ranging set (102), a displacement sensor (103), a hydroelectric signal conversion module (104), and a support controller (105) which are disposed on a working surface. The laser ranging set (102) is disposed below a top beam of a first target hydraulic support among the plurality of hydraulic supports and parallel to a post of the first target hydraulic support, and is configured to determine error length and send the error length to the hydroelectric signal conversion module (104). The displacement sensor (103) is configured to at least obtain the degrees (Continued)

of inclination of the hydraulic supports (101) and send the degrees of inclination to the hydroelectric signal conversion module (104). The hydroelectric signal conversion module (104) is configured to convert the error length and the degrees of inclination into electrical signals and send the electrical signals to a support controller (105) of the first target hydraulic support. The support controller (105) is configured to determine working parameters of the plurality of hydraulic supports on the basis of the electrical signals, so as to adjust the postures of the plurality of hydraulic supports on the basis of the working parameters. Further disclosed is using a detection method for a working surface, a terminal that performs the detection method, and a storage medium.

4 Claims, 8 Drawing Sheets

(56) References Cited

U.S. PATENT DOCUMENTS

| | | | | |
|---|---|---|---|---|
| 8,567,871 | B2 * | 10/2013 | Junker | E21D 23/0004 299/1.7 |
| 2003/0075970 | A1 * | 4/2003 | Hainsworth | E21D 23/14 299/1.6 |
| 2003/0147727 | A1 | 8/2003 | Fujishima | |
| 2004/0221713 | A1 | 11/2004 | Mundry et al. | |
| 2006/0267395 | A1 * | 11/2006 | Kussel | E21D 23/085 299/1.7 |
| 2008/0054705 | A1 * | 3/2008 | Kussel | E21C 35/302 299/1.6 |
| 2018/0155132 | A1 | 6/2018 | Li | |

FOREIGN PATENT DOCUMENTS

| | | | |
|---|---|---|---|
| CN | 104100277 | A | 10/2014 |
| CN | 102661162 | B | 2/2015 |
| CN | 105221178 | A | 1/2016 |
| CN | 106895771 | A | 6/2017 |
| CN | 106996303 | A | 8/2017 |
| CN | 107701216 | A | 2/2018 |
| CN | 109113771 | A | 1/2019 |
| CN | 109519204 | A | 3/2019 |
| CN | 110231626 | A | 9/2019 |
| CN | 108222994 | B | 12/2019 |
| CN | 108663032 | B | 7/2020 |
| CN | 110057324 | B | 9/2020 |
| CN | 211950491 | U | 11/2020 |
| CN | 112377261 | A | 2/2021 |
| CN | 113217068 | A | 8/2021 |
| EP | 4036370 | A1 | 8/2022 |
| FR | 1421042 | A | 12/1965 |
| FR | 2509367 | A1 | 1/1983 |
| GB | 2123886 | A | 2/1984 |
| WO | 2017149526 | A2 | 9/2017 |

OTHER PUBLICATIONS

Written Opinion of the International Search Authority in the international application No. PCT/CN2021/113066, mailed on Jan. 24, 2022. 9 pages with English translation.

Meng Si-jia, Kou Zi-ming, "Research on Fluid-solid Coupling Numerical Simulation of New Type Check Valve for Mine Drainage", Fluid Machinery, vol. 45 , No. 9, 2017, pp. 1-5.

* cited by examiner

DETECTION DEVICE AND METHOD FOR WORKING SURFACE, TERMINAL, AND STORAGE MEDIUM

CROSS-REFERENCE TO RELATED APPLICATIONS

This application claims priority to Chinese Patent Application No. 202110469008.2, filed by Taiyuan University of Technology on Apr. 28, 2021 and entitled "DETECTION DEVICE AND METHOD FOR WORKING SURFACE, TERMINAL, AND STORAGE MEDIUM", the entire contents of which are incorporated herein by reference.

TECHNICAL FIELD

The disclosure relates to information processing technologies, and in particular to a detection device and a detecting method for a working face, a terminal and a storage medium.

BACKGROUND

In the related art, in a straightness detection device of a hydraulic support on a fully mechanized working face at home and abroad, a range finder is installed on each hydraulic support of the working face. Due to the excessive number of the installed range finders, the cost is high, the installation is cumbersome, and the original structure of the fully mechanized working face is changed. In addition, in the process of straightness detection, the distance measured by the range finders of the adjacent hydraulic supports is used as a reference point to continuously move the supports. In this way, an accumulative error will be generated in the process of moving the supports, so that the straightness detection will be inaccurate, and the straightness and the posture state after moving the supports will not meet working requirements.

SUMMARY

In view of this, in order to solve the problems in the related art, embodiments of the disclosure provide a detection device and a detecting method for a working face, a terminal and a storage medium.

An embodiment of the disclosure provides a detection device for a working face, which includes:

a plurality of hydraulic supports, two laser ranging groups, a plurality of displacement sensors, a hydroelectric signal conversion module and a plurality of support controllers, which are arranged on the working face.

Each laser ranging group is arranged below a top beam of a respective one of two first target hydraulic supports of the plurality of hydraulic supports and is parallel to a pillar of the respective one of the two first target hydraulic supports, and each laser ranging group is configured to determine an error length and send the error length to the hydroelectric signal conversion module. The error length is configured to represent an error between a length measured by a respective one of the two laser ranging groups and a length of the working face.

Each displacement sensor is arranged in an advancing oil cylinder of a respective one of the plurality of hydraulic supports, and is configured to obtain at least an inclination of the respective one of the plurality of hydraulic supports and send the inclination to the hydroelectric signal conversion module.

The hydroelectric signal conversion module is configured to convert the error length and the inclination into electrical signals and send the electrical signals to a support controller of a respective one of the two first target hydraulic supports.

The plurality of support controllers are configured to determine working parameters of the plurality of hydraulic supports based on the electrical signals, so as to adjust postures of the plurality of hydraulic supports based on the working parameters.

An embodiment of the disclosure provides a detecting method for a working face, applied to a detection device for the working face. The detection device includes: a plurality of hydraulic supports, a laser ranging group, a displacement sensor, a hydroelectric signal conversion module and a plurality of support controllers, which are arranged on the working face. The detecting method includes the following operations.

An error length is determined by the laser ranging group, and the error length is sent to the hydroelectric signal conversion module by the laser ranging group, in which the error length is configured to represent an error between a length measured by the laser ranging group and a length of the working face.

An inclination of each of the plurality of hydraulic supports is determined by the displacement sensor, and the inclination is sent to the hydroelectric signal conversion module by the displacement sensor.

The error length and the inclination are converted into electrical signals by the hydroelectric signal conversion module, and the electrical signals are sent to the plurality of support controllers of the plurality of hydraulic supports by the hydroelectric signal conversion module.

Working parameters of the plurality of hydraulic supports are determined by the plurality of support controllers based on the electrical signals.

Postures of the plurality of hydraulic supports are adjusted based on the working parameters.

An embodiment of the disclosure provides a terminal, which includes at least a controller, and a storage medium configured to store executable instructions.

The controller is configured to execute stored executable instructions, and the executable instructions are configured to execute the detecting method for the working face provided above.

An embodiment of the disclosure provides a computer readable storage medium having stored thereon computer executable instructions. The computer executable instructions are configured to execute the detecting method for the working face provided above.

The embodiments of the disclosure provide a detection device and a detecting method for a working face, a terminal and a storage medium. The error length between the length between the hydraulic supports measured by the laser ranging group arranged on the first or the last support among the plurality of hydraulic supports of the working face, and the length of the working face is determined, and the inclination of the hydraulic support is determined by the displacement sensor on the hydraulic support. Then, the error length and the inclination are converted by the hydroelectric signal conversion module into electrical signals, and the electrical signals are sent to the support controllers. The support controllers determine the working parameters of the plurality of hydraulic supports of the working face based on the electrical signals, and adjust the postures of the hydraulic supports according to the working parameters. In this way, in the process of moving the hydraulic supports, by using one of the first and last hydraulic supports as the reference point, the postures of the plurality of hydraulic supports of the working face are adjusted according to the error length measured by the laser ranging group arranged on the first or the last hydraulic support of the working face, so that the accumulative error of the posture adjustment is avoided, thereby allowing the posture adjustment to be more accurate, and ensuring that the straightness and the posture state of the hydraulic support of the working face meet the working requirements. In addition, the number of the installed laser ranging groups is small, so that the installation is convenient and simple, the cost is reduced, and no complex structure arrangement is required.

DETAILED DESCRIPTION

Figure 1:
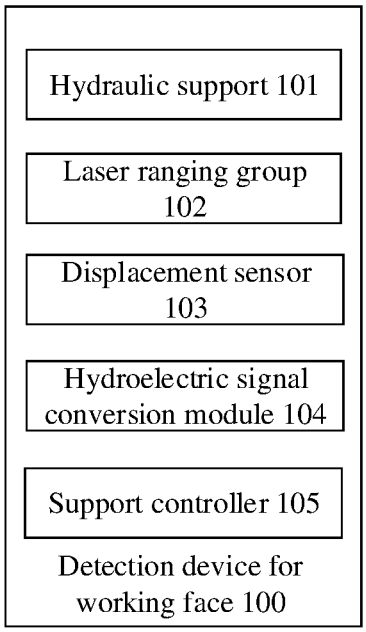
FIG. 1 is a schematic diagram of a detection device for a working face according to an embodiment of the disclosure.

It should be understood that the specific embodiments described herein are only used for explaining the disclosure, but not for limiting the disclosure.

In the following description, suffixes such as "module", "component" or "unit" for denoting elements are intended only to facilitate the description of the disclosure and have no specific meaning of its own. Thus, "module", "component" or "unit" can be combined.

For the convenience of understanding the technical solutions in the embodiments of the disclosure, the relevant technologies of the embodiments of the disclosure are described below.

In the related art, a range finder and an angle sensor are installed on a top beam of a hydraulic support. The range finder is used to measure the distance between the hydraulic support and the coal wall, and the angle sensor is used to detect the posture of the top beam of the hydraulic support. The support controller is installed on the hydraulic support, and is used for state detection and action control of the hydraulic support. In the process of moving the hydraulic support, the distance between the hydraulic support and the coal wall is detected by the range finder, and the moving stroke of the hydraulic support is controlled by the range finder, so that the distances between the hydraulic supports of the working face after being moved and the coal wall can be kept the same, so as to realize the control of the straightness of the hydraulic supports of the working face. The control of the straightness of a scraper conveyor can be realized through an action of pushing rings of the hydraulic supports of the working face, thereby realizing the control of the straightness of the whole working face. However, in this method, the coal wall is selected as a reference. Since the coal wall is difficult to keep straight, the control of the straightness will be biased at source.

In the process of monitoring the straightness, a detection device for detecting the straightness of coal mine hydraulic support arrangement is installed on the top plate of the hydraulic support, and detection mechanisms on the respective hydraulic supports are connected in series by passing a steel wire rope through rope threading rings of the mechanisms. One end of the steel wire rope is led out by a pull rope type displacement sensor and fixed at the end of the working face, and the other end of the steel wire rope is connected to a terminal, such as a computer. In the detection mechanism, a sleeve is fixed and supported by a base, a main shaft passes through the sleeve and a spring and extends into a hollow cylinder of the base, and the other end is connected and fixed with the rope threading ring. A slider type displacement sensor is fixed to the sleeve by bolts, and a cambered auxiliary slider is in sliding contact with a lug boss of the main shaft through a cambered supporting base. The angle sensor is fixed to the end face of the sleeve, and contacts and cooperates with a track groove of the main shaft through a ball in the groove. The main shaft drives the slider to move, and the sensor detects the movement of the slider to obtain a linear displacement. The angle sensor obtains an angle displacement of the rotation of the main shaft. However, the use of steel wire rope in such a device has a problem that the tension of steel wire rope changes greatly due to long time use. Moreover, since the working environment of a coal working face is complex, the use of steel wire rope will increase the working difficulty of the working face.

Therefore, the following technical solution of the embodiments of the disclosure is provided. In order to understand the features and technical contents in the embodiments of the disclosure in more detail, the implementation of the embodiments of the disclosure is elaborated in combination with the accompanying drawings. The accompanying drawings are only used for reference, but not intended to limit the embodiments of the disclosure.

FIG. 1 is a schematic diagram of a detection device for a working face according to an embodiment of the disclosure. As illustrated in FIG. 1, the detection device 100 for the wording face as shown includes: a plurality of hydraulic supports 101, two laser ranging groups 102, a plurality of displacement sensors 103, a hydroelectric signal conversion module 104 and a plurality of support controllers 105, which are arranged on the wording face.

Each laser ranging group 102 is arranged below a top beam of a respective one of two first target hydraulic supports of the plurality of hydraulic supports 101 and is parallel to a pillar of the respective one of the two first target hydraulic supports, and is configured to determine an error length and send the error length to the hydroelectric signal conversion module 104.

Herein, the error length is configured to represent an error between a length measured by a respective one of the two laser ranging groups and a length of the working face. The working face is a fully mechanized working face of coal mine. The important production devices of the working face include: a scraper conveyor, a coal cutter, and the hydraulic supports. The coal cutter can move on a cable channel baffle of the scraper conveyor, and cut the coal from the coal wall. The scraper conveyor is used for conveying the fallen coal out of the coal working face, and also providing a movement support track for the coal cutter. The hydraulic support is used for providing support for the working face and advancing the scraper conveyor. The working face is composed of a plurality of hydraulic supports sequentially arranged on the working face, for supporting the top plate of the working face and transferring the scraper conveyor.

During working, the coal working face is substantially a straight line. In order to realize the normal operation of the working face, it is necessary that the plurality of hydraulic supports of the working face are substantially arranged on the same plane. In the process of coal mining, the scraper conveyor is a track on which the coal cutter runs. Thus, the straightness of the hydraulic supports of the working face is the premise of ensuring the straightness of the scraper conveyor, so that the coal cutter on the scraper conveyor can finally realize a good coal cutting effect. The hydraulic support is composed of a hydraulic cylinder (pillar, jack), a bearing structure (top beam, shield beam, base, etc.), an advancing device, a support controller and other auxiliary devices. The top beam of the hydraulic support is in direct contact with the top plate. The bearing structure transfers the support force and protects the top portion. The pillar is a hydraulic cylinder supported between the top beam and the base.

The advancing process of the hydraulic supports is also the movement of the hydraulic supports relative to the coal wall. With the movement of the hydraulic supports, the position of the scraper conveyor changes. Therefore, the straightness of the scraper conveyor can be better controlled by effectively controlling the straightness of the hydraulic supports on the whole working face during moving, which is the premise of ensuring the straightness of the scraper conveyor, and is also the premise of ensuring the cutting effect of the coal cutter, and also creates a good condition for the next control of the straightness of the working face.

The laser ranging group 102 is a ranging system including at least two laser range finders, a wireless network module and a laser range finder holder. The laser ranging finders are arranged on the laser range finder holder below the top beam of the first target hydraulic support of the plurality of hydraulic supports of the working face, and are parallel to the pillar of the first target hydraulic support. In this way, the length between the hydraulic support where the laser ranging group is located and the hydraulic support blocking the laser lines emitted by the laser range finders of the laser ranging group can be measured in the process of moving the hydraulic supports, and thus an error length can be determined based on this length and the length of the working face. In the disclosure, the length between the hydraulic support where the laser ranging group is located and the hydraulic support blocking the laser lines emitted by the laser range finders of the laser ranging group, which is measured by the laser range finders of the laser ranging group, is referred to as the length between the hydraulic supports. The length of the working face is the distance between the first target hydraulic support where the laser range finders of the laser ranging group 102 are located and the last hydraulic support on the working face reached by the laser signal lines emitted by the laser range finders, which is measured by the laser range finders of the laser ranging group. When the laser ranging group is located below the top beam of the first hydraulic support of the working face, the length of the working face is the distance between the first hydraulic support and the last hydraulic support. When the laser ranging group is located below the top beam of the last hydraulic support of the working face, the length of the working face is the distance between the last hydraulic support and the first hydraulic support. In a specific example, the working face has N hydraulic supports, and the distance between each two hydraulic supports is l. The distance between the supports is the distance between the center lines of two adjacent hydraulic supports. Half of the distance between two pillars of each hydraulic support is h. The laser range finder holder of the laser ranging group is parallel to the pillars of the first and last hydraulic supports of the working face. At the beginning of moving the hydraulic supports, the length of the working face measured by each laser range finder of the laser ranging group is $2h+(N-1)l$. In the process of moving the hydraulic supports, if the last hydraulic support reached by the laser signal line emitted by one of the range finders is the $M^{th}$ hydraulic support among N hydraulic supports, that is, the pillar of the $M^{th}$ hydraulic support blocks the laser line emitted by this laser range finder, with both N and M being positive integers and $M<N$, the length measured by this range finder is $h+(M-1)l$, and thus the error length can be determined as $h+(N-M)l$.

The displacement sensor 103 is arranged in an advancing oil cylinder of a respective one of the plurality of hydraulic supports, and is configured to obtain at least an inclination of the respective one of the plurality of hydraulic supports and send the inclination to the hydroelectric signal conversion module 104.

Herein, the displacement sensor is arranged in the advancing oil cylinder of the hydraulic support to obtain a moving distance of the hydraulic support during moving and a stroke distance during pushing of the scraper. When the straightness and the posture state of the hydraulic support meet the working requirements, the advancing oil cylinder pushes, and the displacement sensor obtains the moving distance of the hydraulic support and the stroke distance of the scraper, determines the inclination of the hydraulic support according to the moving distance, and sends the inclination to the hydroelectric signal conversion module.

In this way, the moving distance is determined by the displacement sensor, and then the inclination of the hydraulic support is determined, so as to adjust the posture of the hydraulic support. In addition, the stroke distance of the scraper can be obtained in the process of moving the supports, so as to ensure the straightness of a crossheading and a chute.

The hydroelectric signal conversion module 104 is installed in an explosion-proof tank of the first target hydraulic support where the laser ranging group is located, and is connected to a power system of the hydraulic support. The hydroelectric signal conversion module 104 receives the error length determined by the wireless network module in the laser ranging group 102 and the inclination of the hydraulic support determined by the displacement sensor, so that the error length and the inclination are converted by the hydroelectric signal conversion module 104 into electrical signals.

In some embodiments, one of the two first target hydraulic supports is a first hydraulic support among the plurality of hydraulic supports arranged at one end of the working face, and the other one of the two first target hydraulic supports is a last hydraulic support among the plurality of hydraulic supports arranged at the other end of the working face.

Herein, the working face has a plurality of hydraulic supports, and the first hydraulic support and the last hydraulic support respectively arranged at both ends of the working face are two hydraulic support respectively located at both ends of the working face. A laser ranging group is provided on each of the first hydraulic support and the last hydraulic support of the working face. When the posture of the hydraulic support is adjusted, according to the adjusting order, from left to right or from right to left, one of the laser ranging groups is determined as the working group, and the other laser ranging group is idle. Since the first target hydraulic supports are the first hydraulic support and the last hydraulic support, according to different hydraulic support moving orders, the first target hydraulic support is the first hydraulic support in the process of moving the supports, and this hydraulic support may be used as a reference point to move other hydraulic supports, so that an accumulative error is avoided, the accuracy of the movement of the supports is ensured, and the accuracy of the error control of the straightness of the hydraulic support is higher.

In this way, it is only necessary to provide one laser ranging group on each of the first hydraulic support and the last hydraulic support of the working face, that is, two laser ranging groups are provided on the working face. In a case that the posture of the hydraulic support is needed to be adjusted, the first hydraulic support or the last hydraulic support can be used as the reference point according to the posture adjusting order, namely the moving order, of the hydraulic support, so as to determine the laser ranging group in the working state according to the posture adjusting order of the hydraulic support. Then, according to the error length determined by the laser range finders of the laser ranging group in the working state, the postures of the other hydraulic supports among the plurality of hydraulic supports may be sequentially adjusted. In this way, the number of the installed laser range finders of the laser ranging group is small, so that the cost is reduced, the installation and setting of the laser range finders is convenient, and the structural arrangement of working devices will not change.

The hydroelectric signal conversion module 104 is configured to convert the error length and the inclination into electrical signals and send the electrical signals to the support controller of a respective one of the two first target hydraulic supports.

Herein, the hydroelectric signal conversion module 104 is installed in the explosion-proof tank of the first target hydraulic support where the laser ranging group is located. The detection device further includes a support controller, a displacement sensor and a voltage module. The laser ranging group 102, the support controller 105, the hydroelectric signal conversion module 104 and the displacement sensor 103 in the detection device are sequentially connected with the power system. In the process of coal mining, the hydroelectric signal conversion module 104 performs data communication with the laser range finders of the laser ranging group through the wireless network module between the laser ranging groups, and converts the received error length determined by the laser range finders and the received inclination of the hydraulic support determined by the displacement sensor into the electrical signals. The hydroelectric signal conversion module 104 is connected to the support controller of the first target hydraulic support through a connector for data communication. The hydroelectric signal conversion module 104 sends the converted electrical signals to the support controller of the first target hydraulic support, so that the support controller can control the posture adjustment of the hydraulic support.

The support controllers 105 are configured to determine working parameters of the plurality of hydraulic supports based on the electrical signals, so as to adjust the postures of the plurality of hydraulic supports based on the working parameters.

Herein, the support controller 105 is responsible for the posture adjustment and control of the hydraulic support, mainly for controlling the actions of a hydraulic system reversing valve, a pillar, an advancing oil cylinder and a balance jack of the hydraulic support, so as to realize the posture adjustment of the hydraulic support. The working parameters include at least the distance between the hydraulic support and the coal wall at the current moment, the moving distance of the hydraulic support, the inclination of the hydraulic support, the straightness of the hydraulic support, etc. It is determined whether the hydraulic support is moved forward or backward according to the distance between the hydraulic support and the coal wall. According to the inclination of the hydraulic support in the process of moving the support, it is ensured that the base plate of the hydraulic support is kept level with the working face by lifting or lowering a base adjusting device of the hydraulic support.

In the embodiments of the disclosure, the error length is determined by the laser ranging group arranged on each of the first and the last hydraulic supports among the plurality of hydraulic supports of working face, and the inclination of the hydraulic support is determined by the displacement sensor on the hydraulic support. Then, the error length and the inclination are converted by the hydroelectric signal conversion module into electrical signals, and the electrical signals are sent to the support controllers. The support controllers determine the working parameters of the plurality of hydraulic supports of the working face according to the electrical signals, and adjust the postures of the hydraulic supports according to the working parameters. In this way, in the process of adjusting the posture of the hydraulic support, by using one of the first and last hydraulic supports as the reference point, the postures of the plurality of hydraulic supports of the working face are adjusted according to the error length determined by the laser ranging groups arranged on the first and last hydraulic supports of the working face, so that the accumulative error of posture adjustment is avoided, thereby allowing the posture adjustment to be more accurate, and ensuring that the straightness and the posture state of the hydraulic support of the working face meet the working requirements. In addition, the number of the installed laser ranging groups is small, so that the installation is convenient and simple, the cost is reduced, and the complex structure arrangement is avoided.

In some realizable implementations, the laser ranging group arranged on the first target hydraulic support of the working face includes at least two laser range finders, a laser range finder holder and a wireless network module. The at least two laser range finders are arranged on the laser range finder holder, and are configured to determine the error length. The laser range finder holder is arranged below the top beam of a respective hydraulic support and is parallel to the pillar of the first target hydraulic support, and is configured to fix the at least two laser range finders. The wireless network module is configured to perform wireless networking on the at least two laser range finders and obtain the error length determined by the at least two laser range finders.

Herein, the laser range finder is an instrument that uses the laser signal line emitted from a laser emitting cavity to measure the distance to a target. In some embodiments, the plurality of hydraulic supports on the working face may be set with serial number identifiers, and the error length is determined according to the serial number identifiers of the hydraulic supports, the distance between the adjacent hydraulic supports and the distance between two pillars of the first target hydraulic support.

The laser range finder holder is fixed at the lower end of the top beam of the hydraulic support by means of a strong magnet installing chassis, so as to facilitate the installation and disassembly without damaging the original structure. The laser range finder holder is configured to fix at least two laser range finders in the laser ranging group. The relative positions between two laser range finder holders of two laser ranging groups arranged on two first target hydraulic supports and the top beams of the hydraulic supports are different. In an example, the working face has N hydraulic supports, and the position relationship between the laser range finder holder of the laser ranging group on the first hydraulic support and the top beam of the first hydraulic support is different from the position relationship between the laser range finder holder of the laser ranging group on the $N^{th}$ hydraulic support and the top beam of the $N^{th}$ hydraulic support. Since the hydraulic supports on the working face maintain the straightness, that is, the hydraulic supports are arranged in the same straight line on the working face, the top beams of the hydraulic supports are also arranged in the same straight line. Since the laser range finder holders are arranged at the lower ends of the top beams of the hydraulic supports, and the position relationships between the laser range finder holders and the top beams of the hydraulic supports are different, the laser range finder holders of two laser ranging groups do not overlap in a Y direction.

The wireless network module may be a ZigBee wireless network module. The wireless network module may perform wireless networking on a plurality of laser range finders arranged on the first and last hydraulic supports. One of the laser range finders, for example, the laser range finder on the first hydraulic support, is used as the master node and connected to a Personal Computer (PC) host (or other upper computers) through the RS232 serial port line, and the other laser range finders are respectively connected to several slave nodes through the RS232 serial port lines. After all the nodes are configured and sequentially powered on, networking is performed automatically. In this case, it is only necessary to send an instruction through the PC host to wirelessly control each laser range finder to work according to the adjusting order of the hydraulic supports, and the length between the hydraulic supports collected by each laser range finder is sequentially obtained by the wireless network. The error length is determined according to the length between the hydraulic supports and the length of the working face.

In this way, the detection of the straightness of the working face under different support moving orders (posture adjusting orders of the hydraulic supports) may be ensured, and the laser range finders of two laser ranging groups do not interfere with each other.

In some embodiments, the relative position relationships between the laser ranging groups arranged on different first target hydraulic supports and the top beams of different first target hydraulic supports are different.

Herein, the first target hydraulic supports are the first hydraulic support and the last hydraulic support at both ends of the working face. Each of the two first target hydraulic supports are provided with a laser ranging group, and each laser ranging group includes three laser range finders. In the process of moving the hydraulic supports, one laser ranging group in the working state is determined according to the moving order of the supports, and the other laser ranging group is in a non-working state. In order to ensure the detection of the straightness of the working face in different moving orders of the supports, and to ensure that the laser range finders of two laser ranging groups do not interfere with each other, the position relationship between the laser range finder holder of the laser ranging group on the first hydraulic support and the top beam of the first hydraulic support is different from the position relationship between the laser range finder holder of the laser ranging group on the last hydraulic support and the top beam of the last hydraulic support. Therefore, the position relationship between the laser ranging group on the first hydraulic support and the top beam of the first hydraulic support is different from the position relationship between the laser ranging group on the last hydraulic support and the top beam of the last hydraulic support. That is, two groups of range finders arranged on different target hydraulic supports do not overlap in the Y direction.

In some realizable implementations, the laser ranging group includes three laser range finders, which are a first laser range finder, a second laser range finder and a third laser range finder. The first laser range finder is configured to determine a first length between a respective first target hydraulic support where the first laser range finder is located and a hydraulic support blocking a laser line emitted by the first laser range finder. The second laser range finder is configured to determine a second length between the respective first target hydraulic support where the second laser range finder is located and a hydraulic support blocking a laser line emitted by the second laser range finder. The third laser range finder is configured to determine a third length between the respective first target hydraulic support where the third laser range finder is located and a hydraulic support blocking a laser line emitted by the third laser range finder.

Herein, the laser ranging group arranged on the first target hydraulic support includes three laser range finders, which are the first laser range finder 1, the second laser range finder 2 and the third laser range finder 3. In the process of coal mining, at the beginning of moving the hydraulic supports, the pillars of all the hydraulic supports are arranged in a straight line, and the lengths between the hydraulic supports measured by the three laser range finders are the same, and thus the error lengths are the same. At different moments when the hydraulic supports are moved, the lengths between the hydraulic supports measured by the three laser range finders are the same or different. When the lengths between the hydraulic supports measured by the three laser range finders are different, the error lengths are also different, which indicates that one of the plurality of hydraulic supports is not moved in place, and this hydraulic support blocks the laser signal line emitted by a certain laser range finder, resulting in that the data collected by the laser range finder is less than the value collected in a case that the laser signal line is not blocked. Since the distance between each two supports and the distance between the centers of each two supports are known as fixed parameters, based on the distance measured when the laser signal line is blocked, the specific hydraulic support which exceeds the support moving threshold may be calculated, and the posture of this hydraulic support may be adjusted.

The line connecting a center of a laser emitting cavity of the first laser range finder and a center of a laser emitting cavity of the second laser range finder is parallel to a piston rod of a pillar of a respective hydraulic support. A plane formed by the three laser range finders is perpendicular to a plane formed by center lines of two pillars of the first target hydraulic support. The first laser range finder and the second laser range finder are arranged on a side of the laser range finder holder away from the coal wall, and the third laser range finder is arranged on a side of the laser range finder holder close to the coal wall.

Herein, if the line connecting the center of the laser emitting cavity of the laser range finder 1 and the center of the laser emitting cavity of the laser range finder 2, which are arranged on the same laser range finder holder, is parallel to the piston rod of the pillar of the hydraulic support, the laser range finder 1 and the laser range finder 2 are arranged on a parallel line parallel to the piston rod of the pillar of the hydraulic support. In the process of moving the hydraulic supports, when the laser signal lines emitted from the laser emitting cavities of the laser range finder 1 and the laser range finder 2 are not blocked, the length between the hydraulic supports measured by the laser range finder 1 is the same as the length between the hydraulic supports measured by the laser range finder 2.

Herein, the laser range finder 1, the laser range finder 2 and the laser range finder 3 arranged on the same laser range finder holder are arranged on the same plane a. The center lines of two pillars of the same target hydraulic support where the three range finders are located are parallel to each other, and form the same plane b. In the process of moving the hydraulic supports, if the laser signal lines emitted from the laser emitting cavities of the laser range finders 1, 2 and 3 are not blocked, the lengths between the hydraulic supports measured by the laser range finders 1, 2 and 3 are the same, and thus the error lengths are the same. The laser range finders 1 and 2 are arranged on a side of the laser range finder holder away from the coal wall, and the laser range finder 3 is arranged on a side of the laser range finder holder close to the coal wall. In this way, it can be determined whether the hydraulic support is moved too much, or the inclination of the hydraulic support in the process of moving the supports can be determined, according to the error length determined based on the length between the hydraulic supports measured by the laser range finder in the process of moving the hydraulic supports. In some embodiments, when the laser range finders 1, 2 and 3 arranged on the same laser range finder holder use the outer pillar of the same hydraulic support where the laser range finders 1, 2 and 3 are located as the reference point, the laser range finders 1 and 2 are arranged at a pillar side away from the coal wall, and the laser range finder 3 is arranged at a pillar side close to the coal wall. Moreover, the installation height of the laser range finder 2 is greater than the lowest height of the piston rod of the pillar of the hydraulic support, so as to ensure that the three laser range finders are all arranged at the piston rod, and the error lengths determined by the three laser range finders will not be interfered by the structure of the hydraulic support.

In some embodiments, taking the straight line where the base of the hydraulic support is located as the horizontal axis, and the straight line perpendicular to the base of the hydraulic support as the longitudinal axis, the installation coordinates of the laser range finders 1, 2 and 3 are respectively $(x_1, y_1)$, $(x_2, y_2)$ and $(x_3, y_3)$. Installation positions of the laser range finders 1, 2 and 3 have the following relationships:

$$\begin{cases} x_2 = x_1 - 2A\cos\alpha \\ y_2 = y_1 - 2A\sin\alpha \end{cases}; \quad (1)$$

$$\begin{cases} x_3 = x_1 + (D_1 + 30) \\ y_3 = y_1 - A\sin\alpha \end{cases}; \quad (2)$$

where 2A is the distance between two points of the laser range finders 1 and 2, $\alpha$ is the included angle between the pillar of the hydraulic support and the reference plane of the base of the hydraulic support, D1 is the diameter of the piston rod of the pillar of the hydraulic support, and 30 is a deviation range of the support that can be controlled by the laser range finders at the front and rear of the pillar.

In this way, at the beginning of moving the hydraulic supports, the error lengths determined according to the lengths between the hydraulic supports measured by the three laser range finders are equal. In addition, in the process of moving the supports, the hydraulic supports may be moved and their postures may be adjusted according to the lengths between the hydraulic supports measured by the three laser range finders, so as to ensure that the straightness and the posture state of the hydraulic supports meet the working requirements.

In some realizable implementations, the detection device for the working face further includes a hydraulic base and a base adjusting module.

The base adjusting module is arranged on the hydraulic base, and is configured to determine an inclination of a hydraulic support to be adjusted based on the first length, the second length and the third length, and detect a posture parameter of the hydraulic support to be adjusted.

Herein, the posture parameter of the hydraulic support to be adjusted is whether the base plate of the hydraulic support is kept level with the working face. The base adjusting module is arranged on the hydraulic base. In the process of moving the supports, it can be determined whether the hydraulic support is inclined according to the magnitude of the first length L1, the second length L2 and the third length L3 between the hydraulic supports respectively measured by the laser range finder 1, the laser range finder 2 and the laser range finder 3. When the hydraulic support is inclined, the inclination of the hydraulic support may be calculated according to the moving distance of the support obtained by the displacement sensor in combination with the distance between the set positions of the laser range finder 1 and the laser range finder 2. And then the target height is lifted or lowered by the base adjusting module according to the inclination, so as to ensure that the base plate of the hydraulic support is kept level with the working face. In a specific example, in the process of moving the supports, if $L1<L2=L3$, it is indicated that the laser signal line emitted by the laser range finder 1 is blocked by a certain hydraulic support, and thus this hydraulic support is the hydraulic support to be adjusted. This hydraulic support is inclined when it is moved. It can be determined which hydraulic support is inclined according to the above method, and then it can be determined that the displacement La monitored by the displacement sensor in the advancing oil cylinder of the inclined hydraulic support, and the distance 2A between the positions of the laser range finder 1 and the laser range finder 2, and thus an angle of inclination $\theta$ may be calculated through the equation $\theta=\arcsin(\alpha\ La/(2A))$. Then, the base plate of the hydraulic support is kept level with the working face through the lifting and lowering distance of the base adjusting module.

In this way, in the process of moving the support, when a certain hydraulic support has a moving error and is inclined, the angle of inclination of the hydraulic support may be adjusted by setting the base adjusting module on the base of the hydraulic support, and the posture parameter of the hydraulic support is detected, so as to ensure that the base plate of the hydraulic support is kept level with the working face, thereby improving the accuracy of the straightness of the hydraulic support.

In some realizable implementations, the hydraulic support of the working face further includes an advancing oil circuit reversing valve and at least one digital flow regulating valve.

The support controllers are configured to determine the working parameters of the plurality of hydraulic supports based on the electrical signals corresponding to each of the first length, the second length and the third length, and to determine, based on the working parameters, a working position of the advancing oil circuit reversing valve of a second target hydraulic support, of which the posture needs to be adjusted, of the plurality of hydraulic supports. The advancing oil circuit reversing valve is configured to adjust the posture of the second target hydraulic support based on the working position.

Herein, the advancing oil circuit reversing valve is a hydraulic system element in the hydraulic support, and is configures to determine the operation and control task of each work of the hydraulic support. That is, by selecting the working position of the advancing oil circuit reversing valve, it can be determined whether the hydraulic support is moved forward or backward. When the reversing valve is in the right position, the hydraulic support is moved forward toward the coal wall. When the reversing valve is in the left position, the hydraulic support is moved backward.

The working parameters include at least the distance between the hydraulic support and the coal wall, the moving distance of the hydraulic support, the inclination of the hydraulic support, the straightness of the hydraulic support, etc. The moving state of each hydraulic support can be determined according to the working parameters, and thus the hydraulic support with the moving error can be determined as the second target hydraulic support. It can be determined according to the working parameters whether the second target hydraulic support needs to be moved forward or backward. When the second target hydraulic support needs to be moved forward, the support controller controls the working position of the advancing oil circuit reversing valve to be in the right position, so as to control the hydraulic support to move forward. When the second target hydraulic support needs to be moved backward, the support controller controls the working position of the advancing oil circuit reversing valve to be in the left position, so as to control the hydraulic support to move backward.

The support controllers are configured to determine the working parameters of the plurality of hydraulic supports based on the electrical signals corresponding to each of the first length, the second length and the third length, and to determine, based on the working parameters, a regulating operation of the at least one digital flow regulating valve of the second target hydraulic support. The at least one digital flow regulating valve is configured to adjust the posture of the second target hydraulic support based on the regulating operation.

Herein, the digital flow regulating valve is a hydraulic system element in the hydraulic support, and is configured for locking the liquid in the hydraulic pillar and the jack working chamber to control the speed in the process of moving the supports. There is a regulating range for the working state of the digital flow regulating valve. Different openings correspond to different support moving speeds, and the size of the opening is directly proportional to the support moving speed.

The working parameters include at least the distance between the hydraulic support and the coal wall, the moving distance of the hydraulic support, the inclination of the hydraulic support, the straightness of the hydraulic support, etc. The moving state of each hydraulic support may be determined according to the working parameters. When the working parameter represents that the hydraulic support is far away from the coal wall, it is necessary to move the support at full speed. In this case, the support controller controls the digital flow regulating valve to fully open, so as to ensure that the hydraulic support is moved at full speed. When the working parameter represents that the hydraulic support is close to the coal wall, the support controller controls the digital flow regulating valve to half open, so as to ensure that the hydraulic support is moved slowly. The regulating operation of the digital flow regulating valve herein refers to the adjustment of opening size of the digital flow regulating valve, such as full open, half open or closed.

In some embodiments, when the working parameter represents that the moving error of the hydraulic support exceeds the threshold, the support controller is required to simultaneously control the operations of the advancing oil circuit reversing valve and the digital flow regulating valve, and adjust the movement and posture of the hydraulic support.

In this way, the working parameters of the hydraulic supports in the process of moving the supports may be determined according to the electrical signals corresponding to the error length. The support controller controls the hydraulic system elements of the hydraulic support, namely the advancing oil circuit reversing valve and the digital flow regulating valve, according to the working parameters, detects the straightness and the posture state of the hydraulic support in the process of moving the supports, and adjusts the straightness and the posture of the hydraulic support in real time, so as to ensure that the straightness and the posture state of the hydraulic support meet the working requirements.

Figure 2:
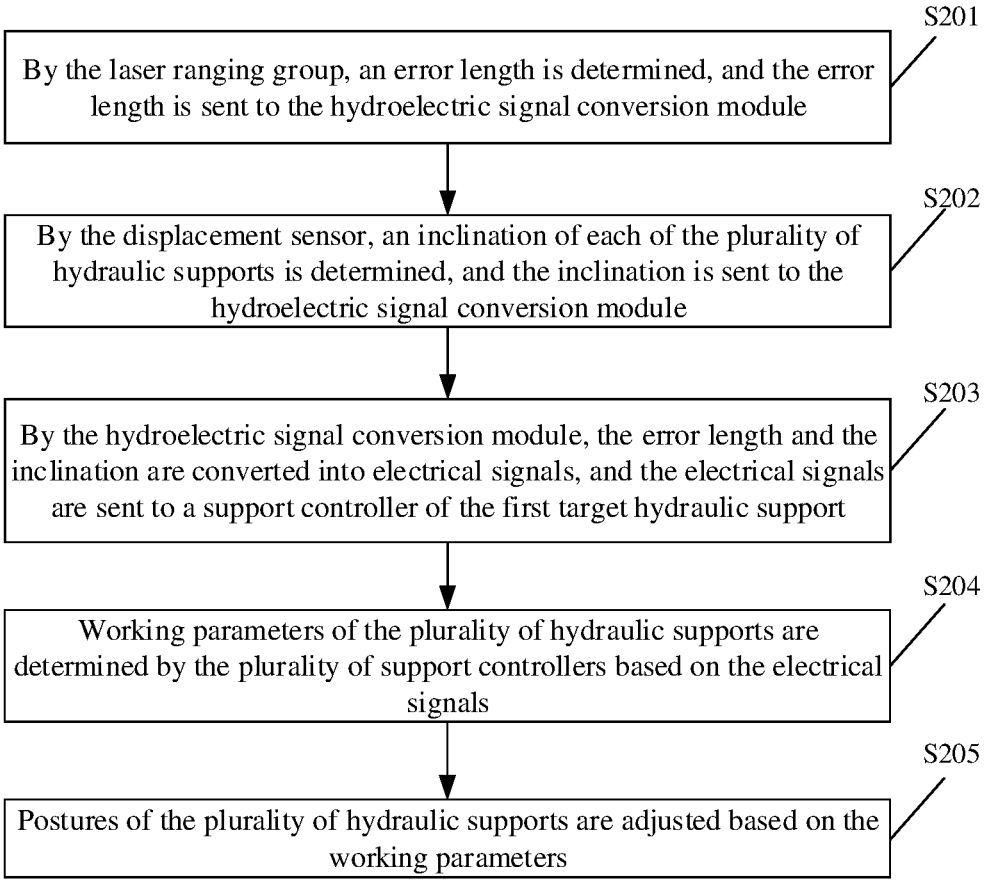
FIG. 2 is a flowchart of a detecting method for a working face according to an embodiment of the disclosure.

FIG. 2 is a flowchart of a detecting method for a working face according to an embodiment of the disclosure. The detecting method is applied to the detection device for the working face. The detection device includes: a plurality of hydraulic supports, a laser ranging group, a displacement sensor, a hydroelectric signal conversion module and a support controller, which are arranged on the working face. As illustrated in FIG. 2, the detecting method includes the following operations.

In S201, by the laser ranging group, an error length is determined, and the error length is sent to the hydroelectric signal conversion module.

Herein, the error length is configured to represent an error between a length measured by the laser ranging group and a length of the working face. The laser ranging group is arranged below a top beam of a first target hydraulic support of the working face. The laser ranging group is arranged below each of a top beam of a first hydraulic support and a top beam of a last hydraulic support among the plurality of hydraulic supports of the working face. The laser ranging group is arranged below each of the top beam of the first hydraulic support and the top beam of the last hydraulic support of the coal working face, so that the laser ranging group in the working state can be used to determine the error length to detect the working face in the support moving order from left to right or from right to left. In the process of moving the hydraulic supports, a laser range finder in the laser ranging group in the working state is determined in the support moving order from left to right or from right to left. The laser range finder may measure, through the emitted laser signal line, the length between the hydraulic support where the laser ranging group is located and the hydraulic support blocking the laser line emitted by the laser range finder in the laser ranging group, referred to as the length between the hydraulic supports, and then determine, based on the length between the hydraulic supports, the error length between the length between the hydraulic supports and the length of the working face. The length of the working face is the distance between the first target hydraulic support where the laser range finder in the laser ranging group is located and the last hydraulic support on the working face reached by the laser signal line emitted by the laser range finder, which is measured by the laser range finder in the laser ranging group.

In an example, in the process of moving the hydraulic supports, if the last hydraulic support reached by the laser signal line emitted by one of the range finders is the $M^{th}$ hydraulic support among N hydraulic supports, that is, the $M^{th}$ hydraulic support blocks the laser line emitted by this laser range finder, with both N and M being positive integers and M<N, the length between the hydraulic supports measured by this range finder is h+(M−1)l. At different moments when the hydraulic support is moved, the lengths between the hydraulic supports measured by the laser ranging group are the same or different.

In S202, by the displacement sensor, an inclination of each of the plurality of hydraulic supports is determined, and the inclination is sent to the hydroelectric signal conversion module.

Herein, when the straightness and the posture state of the hydraulic support meet the working requirements, the advancing oil cylinder pushes, and the displacement sensor obtains the moving distance of the hydraulic support and the stroke distance of the scraper, determines the inclination of the hydraulic support according to the moving distance, and sends the inclination and the stroke distance of the scraper to the hydroelectric signal conversion module. The hydroelectric signal conversion module performs signal conversion to obtain electrical signals, and sends the electrical signals to the support controller.

In S203, by the hydroelectric signal conversion module, the error length and the inclination are converted into electrical signals, and the electrical signals are sent to the support controller of the first target hydraulic support.

Herein, the hydroelectric signal conversion module of the hydraulic support where the laser ranging group is located is used to perform signal conversion, so as to convert the error length and the inclination of the hydraulic support into the electrical signals. The data communication is performed between the hydroelectric signal conversion module and the laser range finder in the laser ranging group through the wireless network module, so that the error length sent by the wireless network module is received, then the hydroelectric signal conversion module is used to convert the received error length and the inclination of the hydraulic support into the electrical signals, and then the electrical signals are sent to the support controller of the first target hydraulic support.

In S204, working parameters of the plurality of hydraulic supports are determined by the support controllers based on the electrical signals.

Herein, the electrical signals are obtained by converting the error length and the inclination of the hydraulic support, which are determined by the laser range finder. The moving state of each hydraulic support in the process of moving the hydraulic supports may be determined based on the electrical signals. According to the moving state of each hydraulic support, the support controller is used to determine the working parameters of each hydraulic support. The working parameters include at least the distance between the hydraulic support and the coal wall, the moving distance of the hydraulic support, the inclination of the hydraulic support, the straightness of the hydraulic support, etc.

In S205, postures of the plurality of hydraulic supports are adjusted based on the working parameters.

Herein, the plurality of hydraulic supports on the working face may be set with serial number identifiers. In the process of moving the supports, based on the electrical signals corresponding to the error length and the inclination of the hydraulic support, the moving state of each of the plurality of hydraulic supports may be determined, and the moving error of each hydraulic support may be determined, so as to determine the serial number identifier of the hydraulic support with the moving error. Then, it can be determined whether the hydraulic support is moved forward or backward and the degree of moving forward or backward according to the moving error. The support controller is used to control the working parameters of the hydraulic elements of the hydraulic support to adjust the posture of the hydraulic support.

In the embodiments of the disclosure, the error length between the length between the hydraulic supports and the length of the working face is determined according to the length between the hydraulic supports measured by the laser ranging group arranged on the first or last hydraulic support of the working face, and the inclination of the hydraulic support is determined by the displacement sensor on the hydraulic support. The error length and the inclination of the hydraulic support are sent to the hydroelectric signal conversion module. Then, the hydroelectric signal conversion module is used to convert the error length and the inclination of the hydraulic support into the electrical signals, and send the error length and the inclination of the hydraulic support to the support controller of the first target hydraulic support. Finally, the support controllers are used to determine the working parameters of the plurality of hydraulic supports of the working face according to the electrical signals, and adjust the postures of the hydraulic supports according to the working parameters. In this way, in the process of moving the hydraulic supports, by using one of the first and last hydraulic supports as the reference point, the postures of the plurality of hydraulic supports of the working face are adjusted according to the length of the working face measured by the laser ranging groups arranged on the first and last hydraulic supports of the working face, so that the accumulative error of the straightness and posture adjustment is avoided, thereby allowing the straightness and the posture adjustment to be more accurate, and ensuring that the straightness and the posture state of the hydraulic support of the working face meet working requirements. In addition, the number of the installed laser ranging groups is small, so that the installation is convenient and simple, the cost is reduced, and the complex structure arrangement is avoided.

In some realizable implementations, each laser ranging group includes three laser range finders, which are a first laser range finder, a second laser range finder and a third laser range finder. S201 may be implemented by the following operations.

In the first operation, a first length between a respective one of the plurality of hydraulic supports where the first laser range finder is located and a hydraulic support blocking a laser line emitted by the first laser range finder is determined by the first laser range finder.

Herein, in the process of moving the hydraulic supports, the laser ranging group in the working state among two laser ranging groups arranged on the first and last hydraulic supports is determined according to the moving order of the hydraulic supports. Each laser ranging group includes three laser range finders. At different moments when the hydraulic supports are moved in the coal mining process, the moving state of a certain hydraulic support may have the moving error. In this case, the pillar of this hydraulic support will block the laser signal line emitted by the laser range finder. When the pillar of a certain hydraulic support blocks the laser signal line emitted by the first laser range finder, the serial number identifier of this hydraulic support is determined, and the first laser range finder may be used to measure the length between the first target hydraulic support where it is located and this hydraulic support.

In the second operation, a second length between the respective one of the plurality of hydraulic supports where the second laser range finder is located and a hydraulic support blocking a laser line emitted by the second laser range finder is determined by the second laser range finder.

In the third operation, a third length between the respective one of the plurality of hydraulic supports where the third laser range finder is located and a hydraulic support blocking a laser line emitted by the third laser range finder is determined by the third laser range finder.

Herein, at the beginning of moving the hydraulic supports, the lengths between the hydraulic supports measured by the three laser range finders in the same laser ranging group are the same, and thus the error lengths determined according to the length between the hydraulic supports are also the same. At different moments of the process of moving the hydraulic supports, the lengths between the hydraulic supports determined by the three laser range finders are the same or different. When the lengths between the hydraulic supports measured by the three laser range finders are different, it is indicated that a certain hydraulic support among the hydraulic supports has the moving error, and thus the posture of this hydraulic support is adjusted according to the error length and the inclination. In the process of adjusting the posture of this hydraulic support, the error length is determined by the lengths between the hydraulic supports measured by the three laser range finders. When the lengths between the hydraulic supports determined by the three laser range finders are the same, posture adjustment is stopped, and the straightness of the hydraulic support is detected.

In the fourth operation, the error length is determined based on the first length, the second length and the third length.

Herein, when the first length, the second length and the third length are the same and equal to the length of the working face, it is indicated that the error length is zero, that is, there is no moving error, and it is not necessary to adjust the posture of the hydraulic support. When the first length is the same as the second length and less than the third length, it is indicated that the laser signal lines emitted by the first laser range finder and the second laser range finder are not blocked, that is, the hydraulic support is not inclined, and the hydraulic support is not moved to the target position. When the first length is the same as the second length and greater than the third length, it is indicated that the laser signal line emitted by the third laser range finder is blocked by a certain hydraulic support, and there is an error length. Moreover, since the third laser range finder is arranged at a side close to the coal wall, the displacement of the hydraulic support exceeds the threshold. In this case, the error length may be determined according to the difference between the first length, the second length and the third length, and the second target hydraulic support with the moving error may be determined.

In the fifth operation, the error length is sent to the hydroelectric signal conversion module.

Herein, the error length is determined according to the lengths between the hydraulic supports measured by the three laser range finders and the length of the working face, and the error length is sent to the hydroelectric signal conversion module. The hydroelectric signal conversion module converts the error length into electrical signals, and sends the electrical signals to the support controller of the first target hydraulic support, so that the support controller of the first target hydraulic support can control the working parameters of the hydraulic elements of the hydraulic system of the hydraulic support corresponding to each error length according to the electrical signals, so as to adjust the postures of the corresponding hydraulic elements.

In this way, at different moments in the process of moving the hydraulic supports, the lengths between the hydraulic supports are respectively measured by three laser range finders in the laser ranging group on the first target hydraulic support to determine the error length, and the error length is sent to the hydroelectric signal conversion module. After the hydroelectric signal conversion module converts the error length into electrical signals and sends the electrical signals to the support controller of the first target hydraulic support, the support controller may control the working parameters of the hydraulic elements of the hydraulic system in real time, so as to detect the moving state of the hydraulic support, thereby adjusting the straightness and the posture of the hydraulic supports in real time in the process of moving the supports. Therefore, the accumulative error of the straightness and the posture adjustment is avoided, thereby allowing the straightness and the posture adjustment to be more accurate, and ensuring that the straightness and the posture state of the hydraulic supports of the working face meet the working requirements. In addition, the number of the installed laser range finders is small, so that the installation is convenient and simple, the cost is reduced, and no complex structure arrangement is needed.

In some realizable implementations, S204 may be implemented by the following operations.

In the first operation, a working position of an advancing oil circuit reversing valve of a second target hydraulic support of the plurality of hydraulic supports is determined based on the working parameters.

Herein, the working position of the advancing oil circuit reversing valve means that the reversing valve is in the left position, the right position or the middle position. When the reversing valve is a three-position reversing valve, its working position is the left position, the right position or the middle position. When the reversing valve is a two-position reversing valve, its working position is the left position or the right position. The reversing valve in the embodiments of the disclosure is a three-position reversing valve. The working parameters include at least the distance between the hydraulic support and the coal wall, the moving distance of the hydraulic support, the inclination of the hydraulic support, the straightness of the hydraulic support, etc.

According to the working parameters, the moving state of each hydraulic support may be determined, and thus the hydraulic support with the moving error is determined as the second target hydraulic support. It is determined according to the working parameters whether the second target hydraulic support needs to be moved forward or backward. When the second target hydraulic support needs to be moved forward, the support controller controls the working position of the advancing oil circuit reversing valve to be in the right position, so as to control the hydraulic support to move forward. When the second target hydraulic support needs to be moved backward, the support controller controls the working position of the advancing oil circuit reversing valve to be in the left position, so as to control the hydraulic support to move backward.

In the second operation, a posture of the second target hydraulic support is adjusted based on the working position.

Herein, when the reversing valve is in the left position, the second target hydraulic support is moved backward. When the reversing valve is in the right position, the second target hydraulic support is moved forward.

In this way, the error length may be determined according to the length between the hydraulic supports measured by the laser range finder of the detection device, and then the working parameters in the process of moving the hydraulic supports may be determined. The support controller controls the hydraulic system elements of the hydraulic support, namely the advancing oil circuit reversing valve and the digital flow regulating valve, according to the working parameters, and detects the straightness and the posture state of the hydraulic support in the process of moving the supports, so as to adjust the straightness and the posture of the hydraulic support in real time, thereby ensuring that the straightness and the posture state of the hydraulic support meet the working requirements.

In some realizable implementations, S205 may also be implemented by the following operations.

In the first operation, a regulating operation of at least one digital flow regulating valve of a second target hydraulic support of the plurality of hydraulic supports is determined based on the working parameters.

Herein, the regulating operation of the digital flow regulating valve includes full opening, half opening and closing of the digital flow regulating valve. The working parameters include at least the distance between the hydraulic support and the coal wall, the moving distance of the hydraulic support, the inclination of the hydraulic support, the straightness of the hydraulic support, etc. When the working parameter represents that the hydraulic support is far away from the coal wall, it is necessary to move the support at full speed. In this case, the support controller controls the digital flow regulating valve to fully open, so as to ensure that the hydraulic support is moved at full speed. When the working parameter represents that the hydraulic support is close to the coal wall, the support controller controls the digital flow regulating valve to half open, so as to ensure that the hydraulic support is moved slowly.

In the second operation, a posture of the second target hydraulic support is adjusted based on the regulating operation of the at least one digital flow regulating valve.

Herein, when the digital flow regulating valve is half open, the second target hydraulic support is slowly moved. When the digital flow regulating valve is full open, the second target hydraulic support is moved at full speed.

In this way, the working parameters in the process of moving the hydraulic supports may be determined according to the electrical signals corresponding to the error length between the length between the hydraulic supports measured by the laser range finder and the length of the working face, so that the support controller can control the hydraulic system elements of the hydraulic support, namely the advancing oil circuit reversing valve and the digital flow regulating valve, according to the working parameters, and detect the straightness and the posture state of the hydraulic support in the process of moving the supports, so as to adjust the straightness and the posture of the hydraulic support in real time, thereby ensuring that the straightness and the posture state of the hydraulic support meet the working requirements.

In some embodiments, when the working parameters represent that the moving error of the hydraulic support exceeds the threshold, it is indicated that the hydraulic support is moved too much. In this case, the support controller is required to simultaneously control the advancing oil circuit reversing valve and the digital flow regulating valve to work, and adjust the straightness and the posture of the hydraulic support.

In some realizable implementations, in the process of adjusting the postures of the plurality of hydraulic supports of the working face, the hydraulic support to be adjusted may be determined. The base adjusting module is used to determine the inclination of the hydraulic support to be adjusted based on the first length, the second length and the third length, and the base adjusting module is used to detect a posture parameter of the hydraulic support to be adjusted.

Herein, the hydraulic support of the working face is further provided with the base adjusting module. In the process of moving the hydraulic supports of the working face, it can be determined whether the hydraulic support is inclined according to the lengths between the hydraulic supports, namely the first length L1, the second length L2 and the third length L3, which are measured respectively by the laser range finder 1, the laser range finder 2 and the laser range finder 3. If the hydraulic support is inclined, the hydraulic support to be adjusted, i.e., the second target hydraulic support, should be determined. When the hydraulic support is inclined, the inclination of the hydraulic support may be calculated according to the support moving distance obtained by the displacement sensor in combination with the distance between the set positions of the laser range finder 1 and the laser range finder 2. Then the base adjusting module lifts or lowers the target height according to the inclination, so as to ensure that the base plate of the hydraulic support is kept level with the working face. In a specific example, in the process of moving the supports, if $L1<L2=L3$, it is indicated that the laser signal line emitted by the laser range finder 1 is blocked by a certain hydraulic support, and thus this hydraulic support is the hydraulic support to be adjusted. This hydraulic support is inclined when it is moved. It can be determined which hydraulic support is inclined according to the above method. La is the displacement data monitored by the displacement sensor in the advancing oil cylinder of the inclined hydraulic support, and 2A is the distance between the positions of the laser range finder 1 and the laser range finder 2. Thus, the inclination $\theta$ of the hydraulic support may be calculated through the equation $\theta=\text{arc}\sin(\alpha\ La/(2A))$. Then, the base plate of the hydraulic support is kept level with the working face through the lifting and lowering distance of the base adjusting module.

In this way, in the process of moving the supports, when a certain hydraulic support has the moving error and is inclined, the inclination of this hydraulic support may be adjusted by using the base adjusting module arranged on the base of the hydraulic support, and the posture parameter of the hydraulic support may be detected, so as to ensure that the base plate of the hydraulic support is kept level with the working face, thereby improving the accuracy of the straightness of the hydraulic support.

Figure 3:
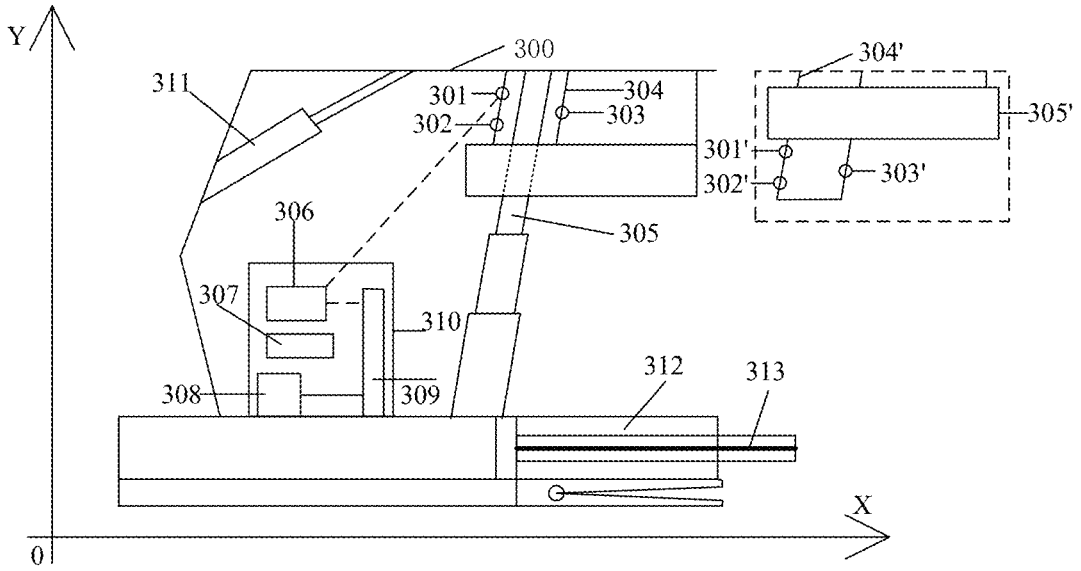
FIG. 3 is another schematic diagram of a detection device for a working face according to an embodiment of the disclosure.

FIG. 3 is another schematic diagram of a detection device for a working face according to an embodiment of the disclosure. The detection device in the embodiments of the disclosure is explained with reference to FIG. 3.

In the embodiments of the disclosure, the detection device mainly consists of hydraulic supports, laser ranging groups, a support controller, a hydroelectric signal conversion module, a power supply system and a displacement sensor. The laser ranging groups, the support controller and the hydroelectric signal conversion module are sequentially connected with the power supply system. Each laser ranging group is arranged below the top beam of the hydraulic support and is parallel to the pillar of the hydraulic support. The power supply system, the support controller and the hydroelectric signal conversion module are arranged in the explosion-proof tank of the base of the hydraulic support. The displacement sensor is arranged in the advancing oil cylinder.

As illustrated in FIG. 3, the detection device includes: a laser range finder 301, a laser range finder 302, a laser range finder 303, a long-distance laser range finder holder 304 and a ZigBee wireless network module 306. The laser range finder may be a long-distance laser range finder. The laser range finder holder 304 is arranged at the lower end of the top beam of the first target hydraulic support. The laser range finder 301, the laser range finder 302 and the laser range finder 303 are arranged on the laser range finder holder 304. The laser range finder 301 and the laser range finder 302 are arranged on the left side of the pillar of the hydraulic support, and the laser range finder 303 is arranged on the right side of the pillar of the hydraulic support. The line connecting the centers of the laser emitting cavities of the laser range finder 301 and the laser range finder 302 is parallel to the piston rod 305 of the pillar of the hydraulic support. The installation height of the laser range finder 302 is greater than the lowest height of the piston rod 305 of the pillar of the hydraulic support. The relationship between the installation positions of the laser range finder 301, the laser range finder 302 and the laser range finder 303 is indicated in the equations (1) and (2). The laser range finder 301, the laser range finder 302, the laser range finder 303 and the laser range finder holder form the laser ranging group.

Each of the first hydraulic support 300 and the last hydraulic support of the fully mechanized working face is provided with a laser ranging group. The laser range finder 301, the laser range finder 302 and the laser range finder 303 are installed on the hydraulic support at one end of the working face, for example, the first hydraulic support 31, and a laser ranging group is installed at the lower end of the top beam of the last hydraulic support at the other end of the working face. This laser ranging group includes: a laser range finder holder 304', a laser range finder 301', a laser range finder 302', a laser range finder 303' and a laser reflector 305'. The range finder holders 304 and 304' at both ends of the working face are avoided overlapping in the Y direction, so as to ensure that the straightness of the working face can be monitored in different support moving orders, without interference with each other.

The outer surface of the piston rod 305 of the pillar of the hydraulic support is chrome plated. The reflectivity of chrome in the visible light range is about 65%, and chrome does not change color after long time use, so that chrome can maintain its reflectivity for a long time.

The laser range finder holders 304 and 304' are fixed at determined positions of the top beam of the hydraulic support by means of the strong magnet installing chassis, so as to facilitate the installation and disassembly without damaging the original structure of the working face.

The ZigBee wireless network module 306 may easily realize the wireless networking of six long-distance laser range finders. The laser range finder 301 is used as the master node and connected to the PC host (or other upper computers) through the RS232 serial port line, and the other five laser range finders are respectively connected to five slave nodes through the RS232 serial port lines. After all the nodes are configured and sequentially powered on, networking is performed automatically. In this case, it is only necessary to send an instruction through the PC host to sequentially wirelessly control each laser range finder to work, and sequentially obtain the data collected by each laser range finder through the wireless network.

The laser range finder 301, the laser range finder 302, the laser range finder 303, the laser range finder holder 304 and the ZigBee wireless network module 306 form a laser ranging group.

The mining height of the hydraulic support in normal operation is H, the included angle between the pillar and the reference plane of the base of the support is $\alpha$, and the diameter of the piston rod 305 of the pillar of the hydraulic support is D1.

The support controller 307 is responsible for controlling the adjustment of the hydraulic support, and mainly for controlling the actions of the reversing valve, the pillar, the advancing oil cylinder and the balance jack of the hydraulic system.

The hydroelectric signal conversion module 308 mainly includes a signal converter for a laser ranging system and the displacement sensor 313, and is configured to convert the data measured by the laser range finder of the laser ranging system and the displacement sensor 313 into corresponding electrical signals, and send the corresponding electrical signals to the support controller 307, so as to adjust the hydraulic system of the hydraulic support to act, thereby meeting the requirements on the straightness and the posture state of the fully mechanized working face.

The power supply system 309 includes a flameproof and intrinsically safe power box and electrical equipment. The rated voltage of the flameproof and intrinsically safe power box is 24V. The flameproof and intrinsically safe power box provides power for the whole control system.

The displacement sensor 313 is arranged in the advancing oil cylinder 312. When both the straightness and the posture state of the hydraulic support meet the requirements, the advancing oil cylinder 312 pushes, and the signal obtained by the displacement sensor 313 is transmitted to the support controller 307 through a hydroelectric signal converter to monitor and control the pushing process, so as to ensure the straightness of the chute.

The power supply system 309, the support controller 307 and the hydroelectric signal conversion module 308 are arranged in the explosion-proof tank 310 of the base of the hydraulic support.

The detection device further includes a balance jack 311, which is a double-acting piston hydraulic cylinder with single piston rod. When the hydraulic pressure of the lower chamber is higher than that of the upper chamber, the balance jack extends outward to support the top plate through the top beam, so that the point of action of the support force balanced with the pressure of the top plate is moved forward, and thus the support efficiency is decreased. When the hydraulic pressure of the upper chamber is higher than that of the lower chamber, the balance jack retracts to pull the top beam downward, so that the point of action of the support force is moved backward, and thus the support efficiency is increased.

In the embodiments of the disclosure, the detection device for detecting the straightness and the posture state of the hydraulic support of the fully mechanized working face has strong universality. The laser ranging method is not only applicable to the movement of single support, but also applicable to the movement of supports in groups, and is also applicable to various hydraulic support types. Moreover, by using the laser range finders, the straightness and the posture state of the hydraulic support may be detected in real time, real-time feedback may be provided on the measured data, and the serial number identifier of the support outside an allowable error range of the straightness may be automatically identified, so as to perform real-time adjustment to ensure that the straightness and the posture state of the hydraulic support meet the work requirements. With the use of non-contact detecting method, there is no additional interference to the fully mechanized working face, the device arrangement with complex structure is not needed, the operation is simple, the installation is convenient, and the cost is low.

Figure 4:
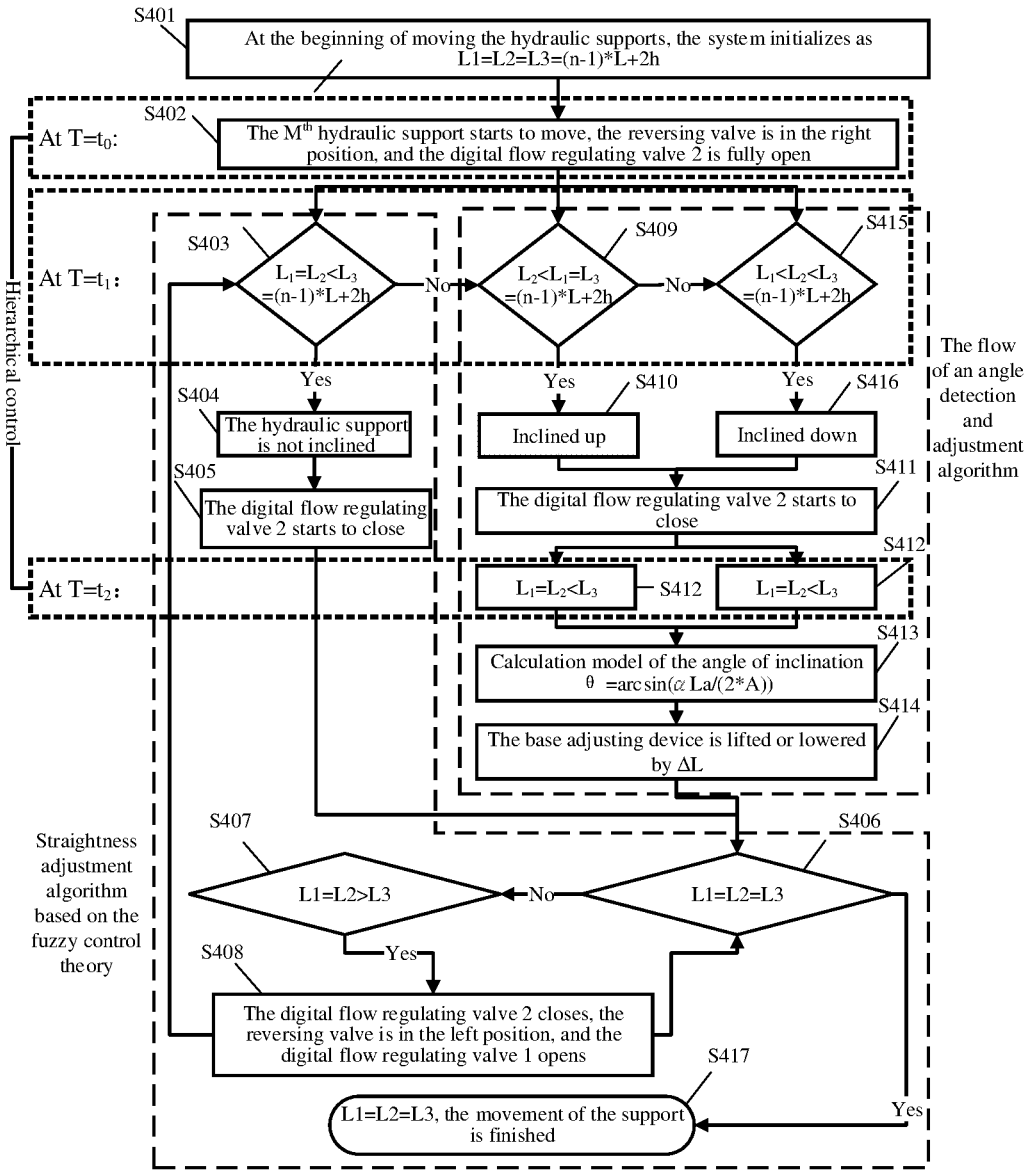
FIG. 4 is a flowchart of an angle detection and adjustment algorithm according to an embodiment of the disclosure.

FIG. 4 is a flowchart of an angle detection and adjustment algorithm according to an embodiment of the disclosure. As illustrated in FIG. 4, the flow of the angle detection and adjustment algorithm is implemented by the following operations.

In S401, at the beginning of moving the hydraulic supports, the system initializes the lengths between the hydraulic supports as L1=L2=L3=(n−1)*L+2h.

Herein, at the beginning of moving the hydraulic supports, the system initializes the lengths between the hydraulic supports measured by three laser range finders to be the same, which is the length of the fully mechanized working face: L1=L2=L3=(n−1)*L+2h. In the embodiments of the disclosure, at different moments when the support is moved, hierarchical control is implemented.

Figure 5:
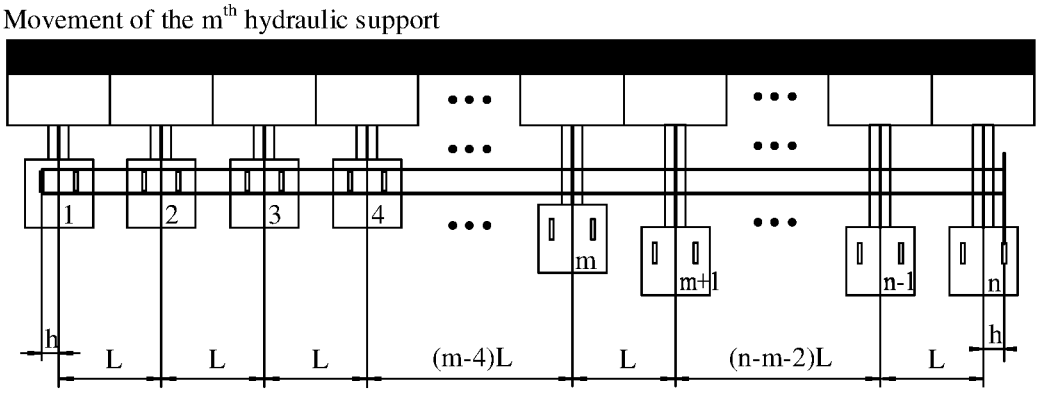
FIG. 5 is a schematic diagram of straightness detection of a laser ranging group according to an embodiment of the disclosure.

FIG. 5 is a schematic diagram of a straightness detection of a laser ranging group according to an embodiment of the disclosure. As illustrated in FIG. 5, the working face is provided with n hydraulic supports, and marked with serial numbers 1, 2, . . . , n. Three laser range finders are provided on the first hydraulic support, and the distance between two adjacent hydraulic supports is L. L1, L2 and L3 are the lengths of the working face respectively measured by the three laser range finders. h is half of the distance between the double pillars of each hydraulic support. At the beginning of moving the hydraulic supports, L1=L2=L3=(n−1)*L+2h. When the $m^{th}$ hydraulic support is moved, the measured distance between the target hydraulic support and the $m^{th}$ hydraulic support is (m−1)*L+h. The distance between the fourth hydraulic support and the $m^{th}$ hydraulic support is (m−4)*L, and the distance between the $(m+1)^{th}$ hydraulic support and the $(n-1)^{th}$ hydraulic support is (n−m−2)*L.

In S402, at T=t0, the $M^{th}$ hydraulic support starts to move, the reversing valve is in the right position, and the digital flow regulating valve is fully open.

Herein, at T=t0, the lengths of the working face measured by the three laser range finders are the same: L1=L2=L3=(n−1)*L+2h. Moreover, the hydraulic support is far away from the coal wall, thus, it is necessary to move the hydraulic support forward at full speed. In this case, the support controller controls the reversing valve to be in the right position, and controls the digital flow regulating valve 2 to fully open.

In S403, at T=t1, it is determined whether L1=L2<L3=(n−1)*L+2h is true.

Herein, at T=t1, if L1=L2<L3=(n−1)*L+2h is true, S404 is executed. If L1=L2<L3=(n−1)*L+2h is not true, S408 is executed.

In S404, it is determined that the hydraulic support is not inclined.

Herein, if L1=L2<L3=(n−1)*L+2h is true, it is indicated that in the process of moving the hydraulic supports, the laser signal lines emitted by the first laser range finder and the second laser range finder are not blocked, that is, the hydraulic support is not inclined, and the hydraulic support is not moved to the target position.

In S405, the digital flow regulating valve 2 is controlled to start to close.

In S406, it is determined whether L1=L2=L3 is true.

Herein, if L1=L2=L3 is true, S418 is executed; if L1=L2=L3 is not true, S407 is executed.

In S407, it is determined whether L1=L2>L3 is true.

Herein, if L1=L2=L3 is true, S408 is executed.

In S408, the digital flow regulating valve 2 is controlled to close, the reversing valve is controlled to the left position, and the digital flow regulating valve 1 is controlled to open.

Herein, during the closing of the digital flow regulating valve 2, L1=L2>L3 is true, which indicates that the laser signal line emitted by the third laser range finder is blocked by a certain hydraulic support. Since the third laser range finder is close to the coal wall side, the displacement of the hydraulic support exceeds the threshold, and the support controller is required to control the hydraulic support to move backward. The support controller controls the digital flow regulating valve 2 to close, controls the reversing valve to the left position, and controls the digital flow regulating valve 1 to open. In the process of moving the supports, the length of the working face and the straightness of the hydraulic support during moving are detected until L1=L2=L3 is true. In this case, the hydraulic support is moved to the target range, and the movement of the support is finished.

Figure 6:
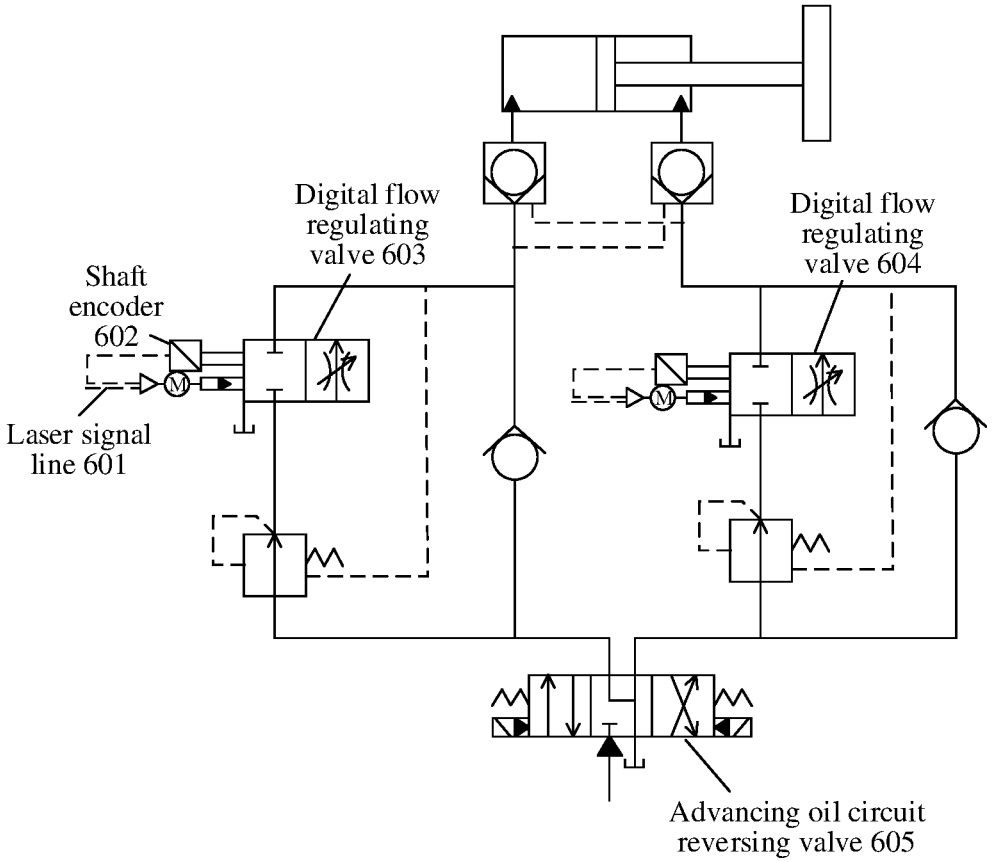
FIG. 6 is a schematic diagram of an advancing oil circuit system according to an embodiment of the disclosure.

FIG. 6 is a schematic diagram of an advancing oil circuit system according to an embodiment of the disclosure. As illustrated in FIG. 6, the advancing oil circuit system includes at least an electrical signal converted from a laser signal line 601, a shaft encoder 602, a digital flow regulating valve 603, a digital flow regulating valve 604 and an advancing oil circuit reversing valve 605.

In S409, it is determined whether L1<L2=L3=(n−1)*L+2h is true.

Herein, if L1<L2=L3=(n−1)*L+2h is true, S410 is executed.

In S410, it is determined that the hydraulic support is inclined up.

Herein, if L1<L2=L3=(n−1)*L+2h is true, it is indicated that the laser signal line emitted by the first laser range finder is blocked by the hydraulic support, and thus the hydraulic support is inclined up.

In S411, the digital flow regulating valve 2 is controlled to close.

In S412, at T=t2, L1=L2<L3.

Herein, at T=t2, during the closing of the digital flow regulating valve 2, the hydraulic support continues to move forward, so as to obtain the length of the working face measured by the laser range finder, obtaining L1=L2<L3.

In S413, the angle of inclination is determined according to a calculation model of the angle of inclination θ=arc sin(α La/(2A)).

Herein, during the closing of the digital flow regulating valve 2, the hydraulic support continues to move forward, obtaining L1=L2<L3. Thus, the angle of inclination of the hydraulic support may be calculated according to θ=arc sin(α La/(2A)), where La is the displacement data monitored by the displacement sensor in the advancing oil cylinder of the inclined hydraulic support, and a is the included angle between the pillar and the advancing oil cylinder.

Figure 7:
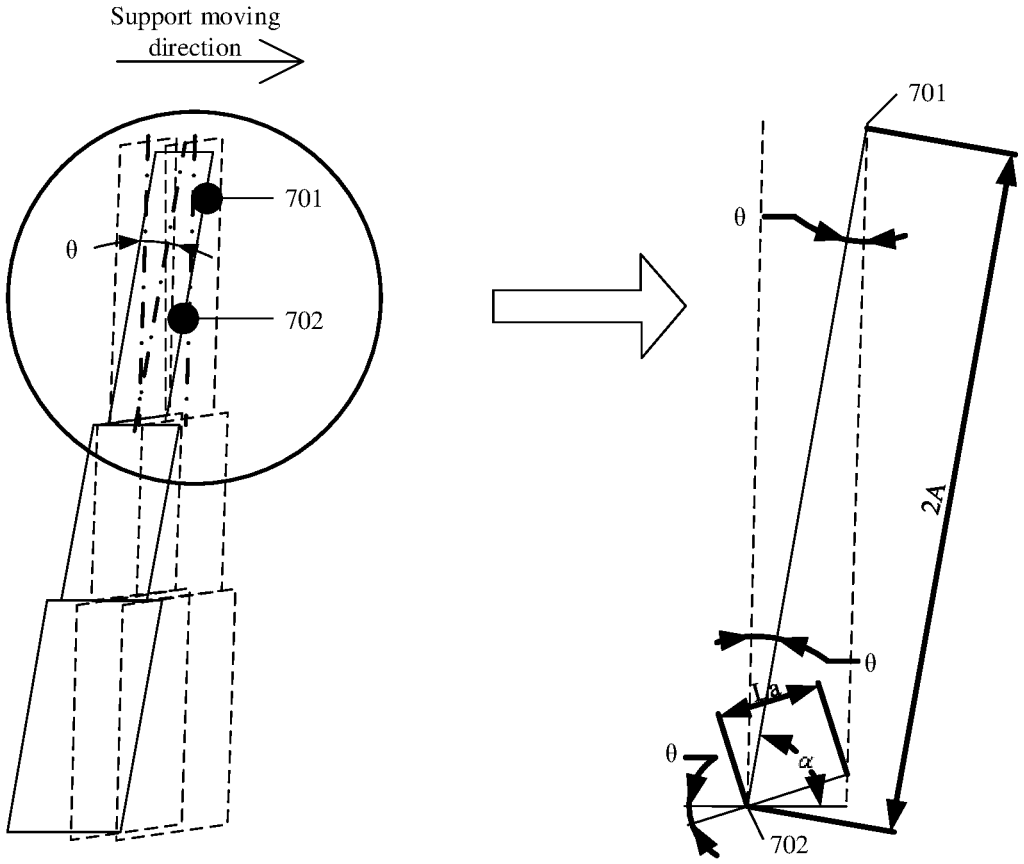
FIG. 7 is a schematic diagram of posture detection of a hydraulic support according to an embodiment of the disclosure.

FIG. 7 is a schematic diagram of posture detection of a hydraulic support according to an embodiment of the disclosure. As illustrated in FIG. 7, the hydraulic support moves from left to right, 701 denotes the laser range finder 1, and 702 denotes the laser range finder 2. 2A is the distance between the laser range finder 1 and the laser range finder 2, La is the displacement data of the hydraulic support monitored by the displacement sensor in the advancing oil cylinder of the inclined hydraulic support, θ is the angle of inclination of the hydraulic support, and a is the included angle between the pillar and the advancing oil cylinder.

In S414, the base adjusting device is lifted or lowered by ΔL.

Herein, a base adjusting module of the hydraulic support is lifted or lowered by ΔL, so as to ensure that the base plate of the hydraulic support is kept level with the working face. After the base adjusting device is lifted or lowered, S406 is executed.

In S415, it is determined whether $L1<L2<L3=(n-1)*L+2h$ is true.

Herein, if $L1<L2<L3=(n-1)*L+2h$ is true, S416 is executed.

In S416, it is determined that the hydraulic support is inclined down.

Herein, if $L1<L2<L3=(n-1)*L+2h$ is true, it is indicated that the laser signal lines emitted by both the first laser range finder and the second laser range finder are blocked by the hydraulic support, and thus the hydraulic support is inclined down. S413 is executed, in which the digital flow regulating valve 2 is controlled to close.

In S417, if $L1=L2=L3$ is true, the movement of the support is finished.

Herein, during the closing of the digital flow regulating valve 2, if $L1=L2=L3$ is true, it is indicated that the hydraulic support is moved to the target region, and then the movement of the support is finished.

The process of adjusting the straightness of the hydraulic support is optimized and adjusted based on the fuzzy control theory. That is, by setting the deviation between the length between the hydraulic supports measured by the laser range finders 1 (or 2) and 3 and the target value $(n-1)*L+2h$, i.e. the error length, as the observed quantity, and dividing the deviation and the opening of the flow valve into fuzzy sets to further establish fuzzy rules and relations thereof, so that the straightness and posture adjustment of the hydraulic support is finally completed.

In the embodiments of the disclosure, by taking the first hydraulic support to be moved according to the moving order of the supports as the reference point, the accumulative error of the straightness and posture adjustment is avoided, and the obtained straightness and posture adjustment of the hydraulic support is more accurate. Moreover, by using the laser range finders, the straightness and the posture state of the hydraulic support may be detected in real time, real-time feedback may be provided on the measured data, and the serial number identifier of the support outside an allowable error range of the straightness may be automatically identified, so as to perform real-time adjustment to ensure that the straightness and the posture state of the hydraulic support meet the work requirements. With the use of non-contact detecting method, there is no additional interference to the fully mechanized working face, the device arrangement with complex structure is not needed, operation is simple, the installation is convenient, and the cost is low.

An embodiment of the disclosure further provides a detection device. The modules included in the device, as well as the sub-modules and units included in each module, may be implemented by a processor in a terminal; of course, they may also be implemented by a specific logic circuit. In the process of implementation, the processor may be a Central Processing Unit (CPU), a Micro-Processor Unit (MPU), a Digital Signal Processor (DSP) or a Field Programmable Gate Array (FPGA).

Figure 8:
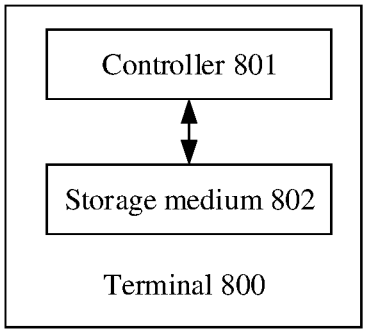
FIG. 8 is a schematic diagram of a composition structure of a terminal according to an embodiment of the disclosure.

Correspondingly, an embodiment of the disclosure provides a terminal. FIG. 8 is a schematic diagram of a composition structure of a terminal according to an embodiment of the disclosure. As illustrated in FIG. 8, the terminal 800 includes at least a controller 801, and a storage medium 802 configured to store executable instructions.

The controller 801 is configured to execute stored executable instructions, and the executable instructions are configured to implement the detecting method for the working face.

It should be noted that the above description about the terminal embodiment is similar to the description about the method embodiment, and has the beneficial effects similar to those of the method embodiment. Technical details undisclosed in the terminal embodiment of the disclosure may be understood with reference to the description about the method embodiment of the disclosure.

Correspondingly, an embodiment of the disclosure provides a computer storage medium having stored thereon computer executable instructions. The computer executable instructions are configured to execute the detecting method for the working face provided in other embodiments of the disclosure.

It should be noted that, herein, terms "include", "comprise" or any other variants thereof are intended to cover non-exclusive inclusions, so that a process, a method, an article or a device including a series of elements not only includes those elements, but also includes those that are not explicitly listed, or further include elements inherent to the process, the method, the article, or the device. In the case that there are no more limitations, an element defined by the phrase "including a/an" does not exclude the existence of other same elements in the process, the method, the article, or the device that includes the element.

The sequence numbers of the above-mentioned embodiments of the disclosure are merely for description, and do not represents the superiority or inferiority of the embodiments.

Through the description of the foregoing implementations, those skilled in the art may clearly understand that the method in the above embodiments may be implemented by means of software and a necessary general hardware platform, and certainly may be implemented by means of hardware. However, in many cases, the former is the better implementation. Based on this understanding, the technical solution of the disclosure essentially or a part that contributes to the related art can be embodied in the form of a software product. The computer software product is stored in a storage medium (for example, a Read Only Memory (ROM)/a Random Access Memory (RAM), a magnetic disk, or an optical disc), and includes several instructions configured to enable a terminal device (which can be a cell phone, a computer, a server, etc.) to execute the method described in each embodiment of the disclosure.

The disclosure is described with reference to flowcharts and/or block diagrams of the method, the terminal (system) and the computer program product according to the embodiments of the disclosure. It should be understood that each flow and/or block in the flowcharts and/or the block diagrams and a combination of the flows and/or blocks in the flowcharts and/or the block diagrams may be implemented by computer program instructions. These computer program instructions can be provided to a processor of a general-purpose computer, a special-purpose computer, an embedded processing machine or other programmable data processing terminals to generate a machine, so that the instructions executed by the processor of a computer or other programmable data processing terminals generate a device configured to implement the functions specified in one flow or multiple flows in the flowchart and/or one block or multiple blocks in the block diagram.

These computer program instructions may also be stored in the computer-readable memory which can guide a computer or other programmable data processing terminals to work in a specific mode, so that the instructions stored in the computer-readable memory generate a manufacturing product including an instruction device, and the instruction device implements the functions specified in one flow or multiple flows in the flowcharts and/or one block or multiple blocks in the block diagrams.

These computer program instructions may also be loaded onto a computer or other programmable data processing terminals, so that a series of operation steps are performed on the computer or other programmable terminals to generate computer-implemented processing, and then, the instructions executed on the computer or other programmable terminals provide steps for implementing the functions specified in one flow or multiple flows in the flowcharts and/or one block or multiple blocks in the block diagrams.

The above embodiments are only the preferred embodiments of the disclosure, and do not limit the patent scope of the disclosure. Any equivalent structure or equivalent flow transformation made by the specification and accompanying drawings of the disclosure, or directly or indirectly applied to other related technical fields, are also included in the patent protection scope of the disclosure.

INDUSTRIAL APPLICABILITY

The embodiments of the disclosure provide a detection device and a detecting method for a working face, a terminal and a storage medium. The detection device includes: a plurality of hydraulic supports, laser ranging groups, a displacement sensor, a hydroelectric signal conversion module and a support controller, which are arranged on the working face. Each laser ranging group is arranged below a top beam of a first target hydraulic support of the plurality of hydraulic supports and is parallel to a pillar of the first target hydraulic support, and is configured to determine an error length and send the error length to the hydroelectric signal conversion module. The displacement sensor is configured to obtain at least an inclination of the hydraulic support and send the inclination to the hydroelectric signal conversion module. The hydroelectric signal conversion module is configured to convert the error length and the inclination into electrical signals and send the electrical signals to the support controller of the first target hydraulic support. The support controllers are configured to determine working parameters of the plurality of hydraulic supports based on the electrical signals, so as to adjust the postures of the plurality of hydraulic supports based on the working parameters. In this way, in the process of moving the hydraulic supports, by using one of the first and last hydraulic supports as the reference point, the postures of the plurality of hydraulic supports of the working face are adjusted according to the error length measured by the laser ranging group arranged on the first or the last hydraulic support of the working face, so that the accumulative error of the posture adjustment is avoided, thereby allowing the posture adjustment to be more accurate, and ensuring that the straightness and the posture state of the hydraulic support of the working face meet working requirements. In addition, the number of the installed laser ranging groups is small, so that the installation is convenient and simple, the cost is reduced, and no complex structure arrangement is required.

What is claimed is:

1. A detection device for a working face, comprising:

a plurality of hydraulic supports, two laser ranging groups, a plurality of displacement sensors, a signal convertor and a plurality of support controllers, which are arranged on the working face, wherein each laser ranging group is arranged below a top beam of a respective one of two first target hydraulic supports of the plurality of hydraulic supports and is parallel to a pillar of the respective one of the two first target hydraulic supports, wherein each laser ranging group is configured to determine an error length and send the error length to the signal convertor, wherein the error length is configured to represent an error between a length measured by a respective one of the two laser ranging groups and a length of the working face;

wherein each displacement sensor is arranged in an advancing oil cylinder of a respective one of the plurality of hydraulic supports, and is configured to obtain at least an inclination of the respective one of the plurality of hydraulic supports and send the inclination to the signal convertor;

wherein the signal convertor is configured to convert the error length and the inclination into electrical signals and send the electrical signals to a support controller of a respective one of the two first target hydraulic supports;

wherein the plurality of support controllers are configured to determine working parameters of the plurality of hydraulic supports based on the electrical signals to adjust postures of the plurality of hydraulic supports based on the working parameters;

wherein one of the two first target hydraulic supports is a first hydraulic support among the plurality of hydraulic supports arranged at one end of the working face, and another one of the two first target hydraulic supports is a last hydraulic support among the plurality of hydraulic supports arranged at another end of the working face, and the length of the working face is a distance between the first hydraulic support and the last hydraulic support;

wherein each laser ranging group comprises a laser range finder holder, a wireless network component and three laser range finders, which are a first laser range finder, a second laser range finder, and a third laser range finder;

wherein the three laser range finders are arranged on the laser range finder holder, and are configured to determine the error length;

wherein the laser range finder holder is arranged below the top beam of the respective one of the two first target hydraulic supports and is parallel to the pillar of the respective one of the two first target hydraulic supports, and the laser range finder holder is configured to fix the three laser range finders;

wherein the first laser range finder is configured to determine a first length between a respective one of the two first target hydraulic supports where the first laser range finder is located and a hydraulic support blocking a laser line emitted by the first laser range finder;

wherein the second laser range finder is configured to determine a second length between the respective one of the two first target hydraulic supports where the second laser range finder is located and a hydraulic support blocking a laser line emitted by the second laser range finder;

wherein the third laser range finder is configured to determine a third length between the respective one of the two first target hydraulic supports where the third laser range finder is located and a hydraulic support blocking a laser line emitted by the third laser range finder;

wherein a line connecting a center of a laser emitting cavity of the first laser range finder and a center of a laser emitting cavity of the second laser range finder is parallel to a piston rod of a pillar of the respective one of the two first target hydraulic supports;

wherein a plane formed by the three laser range finders is perpendicular to a plane formed by center lines of two pillars of the respective one of the two first target hydraulic supports;

wherein the first laser range finder and the second laser range finder are arranged on a side of the laser range finder holder away from a coal wall, and the third laser range finder is arranged on a side of the laser range finder holder close to the coal wall;

wherein the wireless network component is configured to perform wireless networking on the three laser range finders and obtain the first length, the second length and the third length, and determine the error length based on the first length, the second length, the third length and the length of the working face, and send the error length to the signal convertor;

wherein each of the plurality of hydraulic supports comprises an advancing oil circuit reversing valve and at least one digital flow regulating valve;

wherein the plurality of support controllers are configured to determine the working parameters of the plurality of hydraulic supports based on electrical signals corresponding to each of the first length, the second length and the third length, and determine and control, based on the working parameters, a working position of an advancing oil circuit reversing valve of a second target hydraulic support, of which a posture needs to be adjusted, of the plurality of hydraulic supports;

wherein the advancing oil circuit reversing valve is configured to adjust the posture of the second target hydraulic support based on the working position;

wherein the plurality of support controllers are configured to determine the working parameters of the plurality of hydraulic supports based on the electrical signals corresponding to each of the first length, the second length and the third length, and determine and control a regulating operation of at least one digital flow regulating valve of the second target hydraulic support based on the working parameters; and wherein the at least one digital flow regulating valve is configured to adjust the posture of the second target hydraulic support based on the regulating operation.

2. The detection device according to claim 1, wherein a relative position relationship between one of the two laser ranging groups arranged on one of the two first target hydraulic supports and the top beam of said one of the two first target hydraulic supports is different from a relative position relationship between another one of the two laser ranging groups arranged on another one of the two first target hydraulic supports and the top beam of said another one of the two first target hydraulic supports.

3. A detecting method for a working face, applied to a detection device for the working face, the detection device comprising: a plurality of hydraulic supports, a laser ranging group, a displacement sensor, a signal convertor and a plurality of support controllers, which are arranged on the working face; wherein each of the plurality of hydraulic supports comprises an advancing oil circuit reversing valve and at least one digital flow regulating valve; wherein the laser ranging group is arranged below a top beam of a respective one of two first target hydraulic supports of the working face; wherein the laser ranging group comprises a laser range finder holder, a wireless network component and three laser range finders, which are a first laser range finder, a second laser range finder, and a third laser range finder; wherein the three laser range finders are arranged on the laser range finder holder; wherein the laser range finder holder is arranged below the top beam of the respective one of the two first target hydraulic supports and is parallel to a pillar of the respective one of the two first target hydraulic supports, and the laser range finder holder is configured to fix the three laser range finders; wherein a line connecting a center of a laser emitting cavity of the first laser range finder and a center of a laser emitting cavity of the second laser range finder is parallel to a piston rod of a pillar of the respective one of the two first target hydraulic supports; wherein a plane formed by the three laser range finders is perpendicular to a plane formed by center lines of two pillars of the respective one of the two first target hydraulic supports; and wherein the first laser range finder and the second laser range finder are arranged on a side of the laser range finder holder away from a coal wall, and the third laser range finder is arranged on a side of the laser range finder holder close to the coal wall;

the detecting method comprising:

by the laser ranging group, determining an error length and sending the error length to the signal convertor, wherein the error length is configured to represent an error between a length measured by the laser ranging group and a length of the working face; wherein one of the two first target hydraulic supports is a first hydraulic support among the plurality of hydraulic supports arranged at one end of the working face, and another one of the two first target hydraulic supports is a last hydraulic support among the plurality of hydraulic supports arranged at another end of the working face, and the length of the working face is a distance between the first hydraulic support and the last hydraulic support;

by the displacement sensor, determining an inclination of each of the plurality of hydraulic supports and sending the inclination to the signal convertor;

by the signal convertor, converting the error length and the inclination into electrical signals and sending the electrical signals to a support controller of a respective one of the two first target hydraulic supports;

determining, by the plurality of support controllers, working parameters of the plurality of hydraulic supports based on the electrical signals; and adjusting postures of the plurality of hydraulic supports based on the working parameters;

wherein by the laser ranging group, determining the error length and sending the error length to the signal convertor comprises:

determining, by the first laser range finder, a first length between a respective one of the plurality of hydraulic supports where the first laser range finder is located and a hydraulic support blocking a laser line emitted by the first laser range finder;

determining, by the second laser range finder, a second length between the respective one of the plurality of hydraulic supports where the second laser range finder is located and a hydraulic support blocking a laser line emitted by the second laser range finder;

determining, by the third laser range finder, a third length between the respective one of the plurality of hydraulic supports where the third laser range finder is located and a hydraulic support blocking a laser line emitted by the third laser range finder; and by the wireless network component, performing wireless networking on the three laser range finders and obtaining the first length, the second length and the third length, determining the error length based on the first length, the second length, the third length and the length of the working face, and sending the error length to the signal convertor;

wherein adjusting the postures of the plurality of hydraulic supports based on the working parameters comprises:

by the plurality of support controllers, determining and controlling, based on the working parameters, a working position of an advancing oil circuit reversing valve of a second target hydraulic support of the plurality of hydraulic supports, and adjusting a posture of the second target hydraulic support based on the working position; or by the plurality of support controllers, determining and controlling, based on the working parameters, a regulating operation of at least one digital flow regulating valve of a second target hydraulic support of the plurality of hydraulic supports, and adjusting a posture of the second target hydraulic support based on the regulating operation.

4. The detecting method according to claim 3, further comprising:

determining a hydraulic support to be adjusted when the postures of the plurality of hydraulic supports of the working face are adjusted; and based on the first length, the second length and the third length, determining an inclination of the hydraulic support to be adjusted, and detecting a posture parameter of the hydraulic support to be adjusted.

* * * * *